US007021489B2

(12) United States Patent
Wilson

(10) Patent No.: US 7,021,489 B2
(45) Date of Patent: Apr. 4, 2006

(54) MAGNIFYING HOUSING FOR CONTAINERS

(76) Inventor: Pamela R. Wilson, P.O. Box 2690, Castro Valley, CA (US) 94546

( * ) Notice: Subject to any disclaimer, the term of this patent is extended or adjusted under 35 U.S.C. 154(b) by 0 days.

(21) Appl. No.: 10/365,261

(22) Filed: Feb. 11, 2003

(65) Prior Publication Data

US 2003/0150867 A1 Aug. 14, 2003

Related U.S. Application Data

(60) Provisional application No. 60/356,841, filed on Feb. 12, 2002.

(51) Int. Cl.
*B65D 25/54* (2006.01)

(52) U.S. Cl. ..... 220/664

(58) Field of Classification Search ..... 220/663, 220/664; 359/804, 710
See application file for complete search history.

(56) References Cited

U.S. PATENT DOCUMENTS

| | | | | | |
|---|---|---|---|---|---|
| 3,052,158 | A * | 9/1962 | Sonni | 374/191 |
| 3,530,723 | A * | 9/1970 | Hogue et al. | 73/431 |
| 4,702,385 | A * | 10/1987 | Shillington et al. | 220/481 |
| 5,193,032 | A * | 3/1993 | Hirth | 359/804 |
| 5,366,073 | A * | 11/1994 | Turrentine et al. | 206/309 |
| 5,590,782 | A * | 1/1997 | Haber et al. | 206/528 |
| 6,366,401 | B1 * | 4/2002 | Gonda et al. | 359/440 |
| 6,634,108 | B1 * | 10/2003 | Luttgens | 30/454 |

* cited by examiner

*Primary Examiner*—Stephen Castellano
(74) *Attorney, Agent, or Firm*—Jill L. Robinson

(57) ABSTRACT

A magnification device for use with a container, particularly a container for medicine, having a housing adapted to receive the container, where the housing is at least partly constructed of a magnifying material, and a structure for inhibiting the rotation of the container relative to the housing.

2 Claims, 11 Drawing Sheets

MAGNIFYING HOUSING FOR CONTAINERS

CROSS-REFERENCE TO RELATED APPLICATIONS

This is a CONTINUATION-IN-PART of pending U.S. Provisional Patent Application No. 60/356,841, filed Feb. 12, 2002 (which is incorporated by reference herein).

TECHNICAL FIELD

This invention relates generally to magnifying devices adapted to magnify small print on labels of containers, especially containers for medicine.

BACKGROUND

As people grow older, they often experience a diminished ability to read small print. Unfortunately, many container labels, particularly medicinal containers, use small print, even for the most critical information such as correct dosage, directions and safety warnings. Thus, many older people and others who have difficulty reading small print are at risk to make errors in taking medication.

Although magnifying glasses and similar devices are available, they are easily lost and are thus not always convenient to use.

The present invention provides for a device that can easily be utilized to magnify small print on labels particularly on containers for medicine. The device is designed to be kept with the container with which it is used, but can be easily removed for reuse.

SUMMARY OF THE INVENTION

The present invention is a magnifying housing into which a bottle or other container may be inserted. Since most medicinal containers are essentially cylindrical, it is expected that the housing will also be cylindrical, although other shapes could be used to accommodate other types of containers. The housing is wholly or partially constructed of magnifying lens plastic, preferably forming a convex lens. The housing is of a size selected such that when the container is inserted into the housing, that portion of the container that includes the label is may be positioned to be in contact with or is close to the lens. Preferably, the entire portion of the housing that is designed to surround the container is of the magnifying lens plastic allowing magnification of the entire exterior of the container.

The magnifying lens plastic may be made to be at different levels of magnification, thus allowing the user to select a device having the degree of magnification suited for their specific needs.

A key feature of the device is a means to prevent the container from turning within the housing when the bottle is opened. This may be accomplished in a number of ways, including providing for a bottom end to the housing the interior portion of which is coated with a slip resistant material; a locking mechanism that is designed to cooperate with a corresponding mechanism molded or otherwise attached to the external bottom portion of the container, and a set of locking ridges placed within the housing, preferably near the open top.

The device may be manufactured in different sizes corresponding to the standard sizes of containers used for medicine and other products.

Other features and advantages of the current invention will appear from the following description in which the preferred embodiments have been set forth in detail in conjunction with the accompanying drawings.

DETAILED DESCRIPTION

Figure 1:
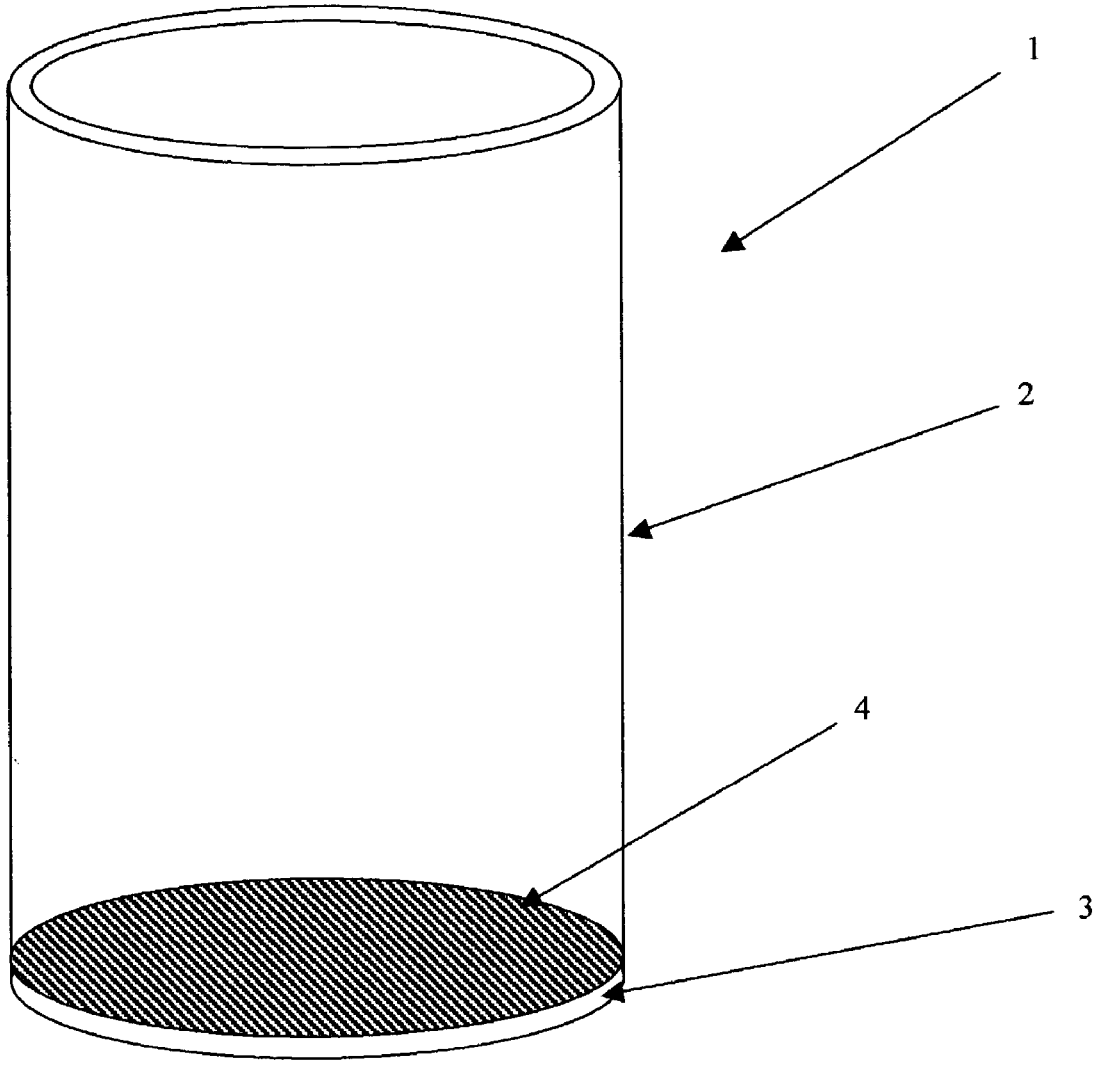
FIG. 1 shows a first embodiment of the device including a cylindrical housing with sides of a magnifying material and a bottom end portion coated with a slip resistant material.

FIG. 1 shows a first embodiment of the device including a substantially cylindrical housing 1, including walls 2 constructed of a substantially transparent magnifying material such as magnifying lens plastic. The first embodiment of the device further includes a bottom end portion 3 attached, or unitarily constructed with, the walls 2. The interior surface 4 of the bottom end portion is "non-slip". This may be achieved by the use of a non-slip coating, such as latex, applied to the bottom end portion 3 either before or after it is attached to the walls 2, or, alternatively, the bottom end portion 3 may be constructed of a material that is non-slip or that can be manufactured to be non-slip.

Figure 2:
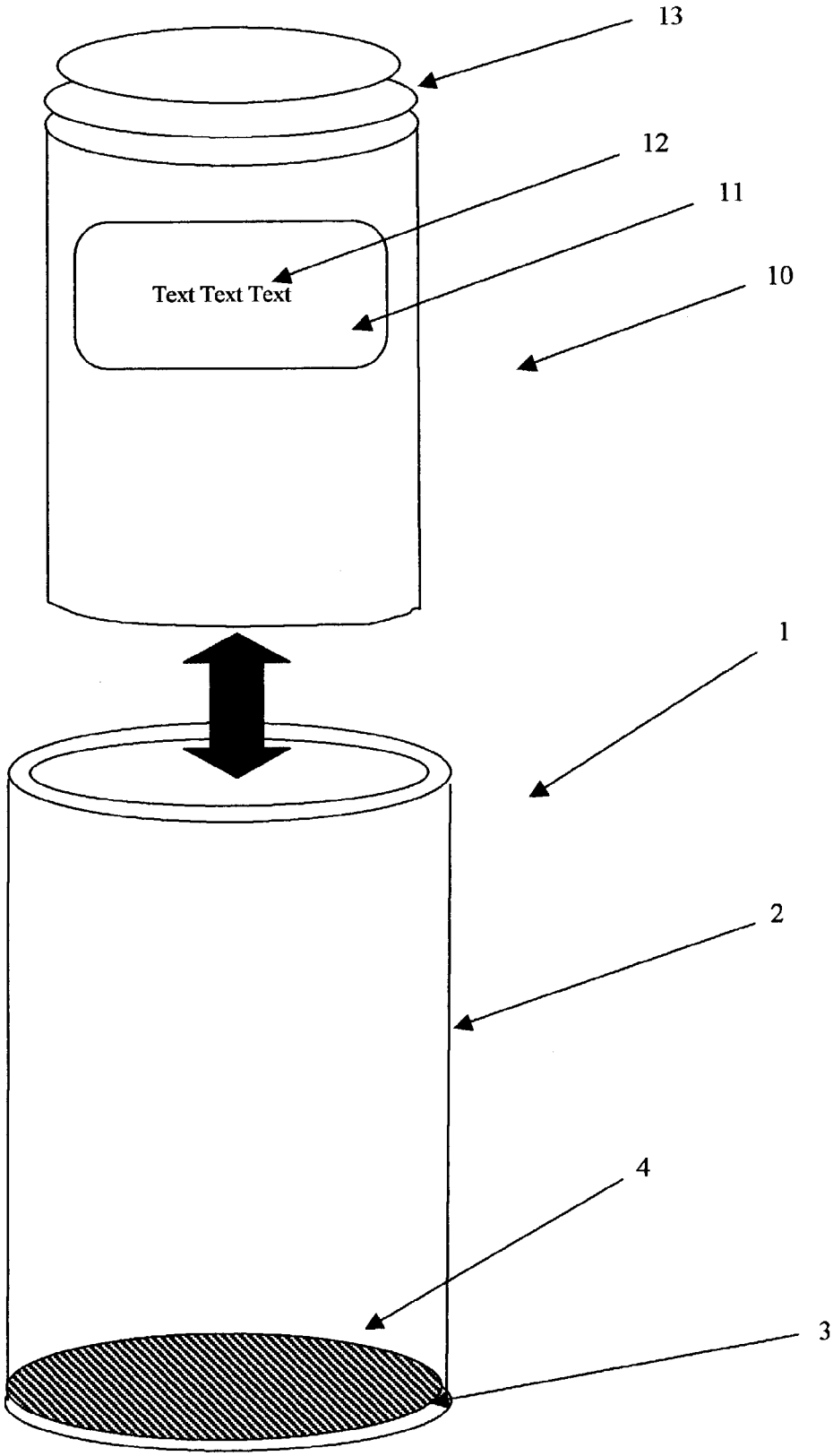
FIG. 2 shows a container being placed into the housing.
Figure 3:
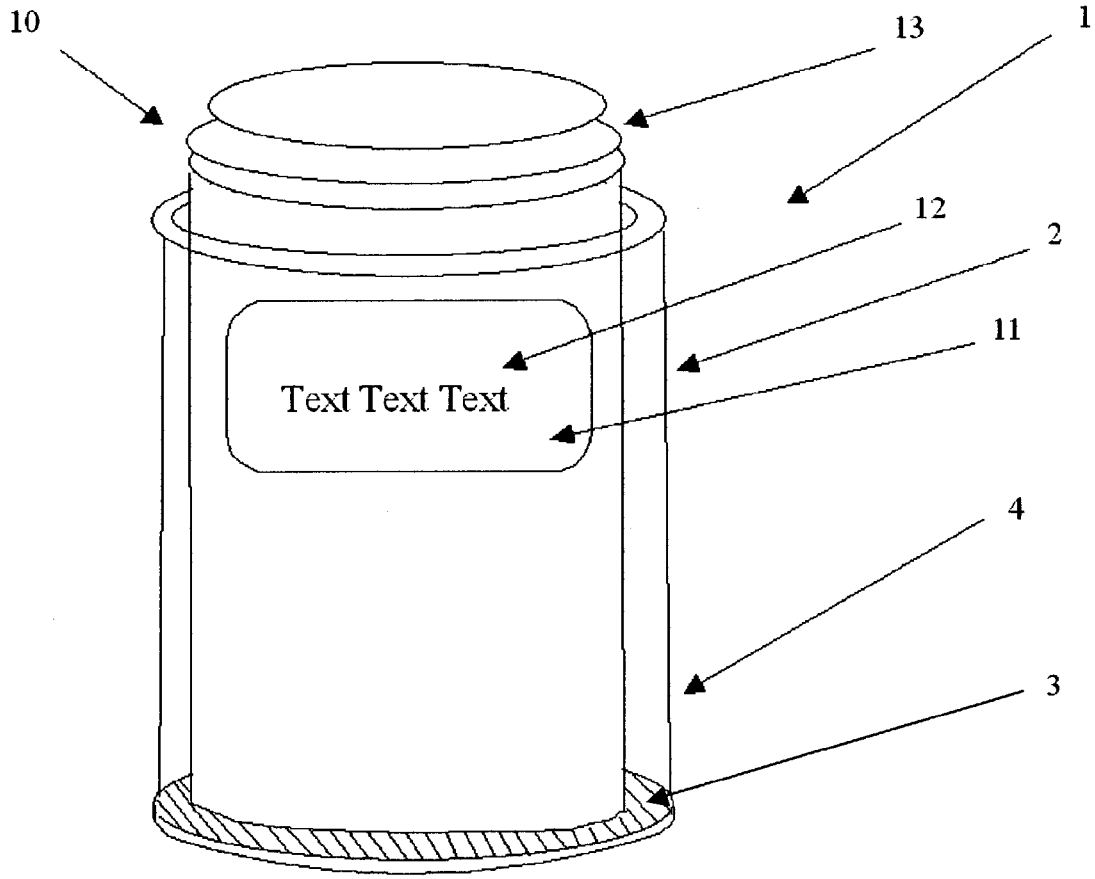
FIG. 3 shows the container within the housing and the magnifying effect of the device.

With references to FIGS. 2 and 3, a bottle 10 or other container, with a label 11 including writing 12, may be placed into the housing 1 such that the label 11 and writing 12 are in close proximity or touching the interior of the walls 2 of magnifying material. When placed into the housing 1, the writing 12 appears larger when viewed through the walls 2. The magnifying lens plastic may be made to be at different levels of magnification, thus allowing the user to select a device having the degree of magnification suited for their specific needs.

Although the bottle 10 may be easily removed from and/or adjusted within the housing by lifting the bottle vertically, the non-slip interior surface 4 of the bottom end portion holds the bottle 10 in place when the cap 13 of the bottle 10 is turned. This allows the use of the device with bottles having screw-type caps. In the embodiment shown the bottom end portion is solid, such that the housing 1 is a cylinder with one closed end, and the entire interior surface 4 is non-slip. However, persons of ordinary skill in the art will appreciate that the bottom end portion 3 may have cut-out sections provided that the bottom end portion is sufficient to support the bottle 10 and/or the non-slip surface may cover less than the entire surface area, provided that there is sufficient non-slip surface area to prevent the bottle 10 from turning when the bottle is opened.

It will be noted that while the sides are preferably entirely constructed of magnifying material, it would be possible to have some portion of the sides constructed of non-magnifying material, provided that the bottle may be positioned such that when the bottle is in place within the housing, the portion of the label to be magnified is adjacent to the magnifying portion of the sides.

Figure 4:
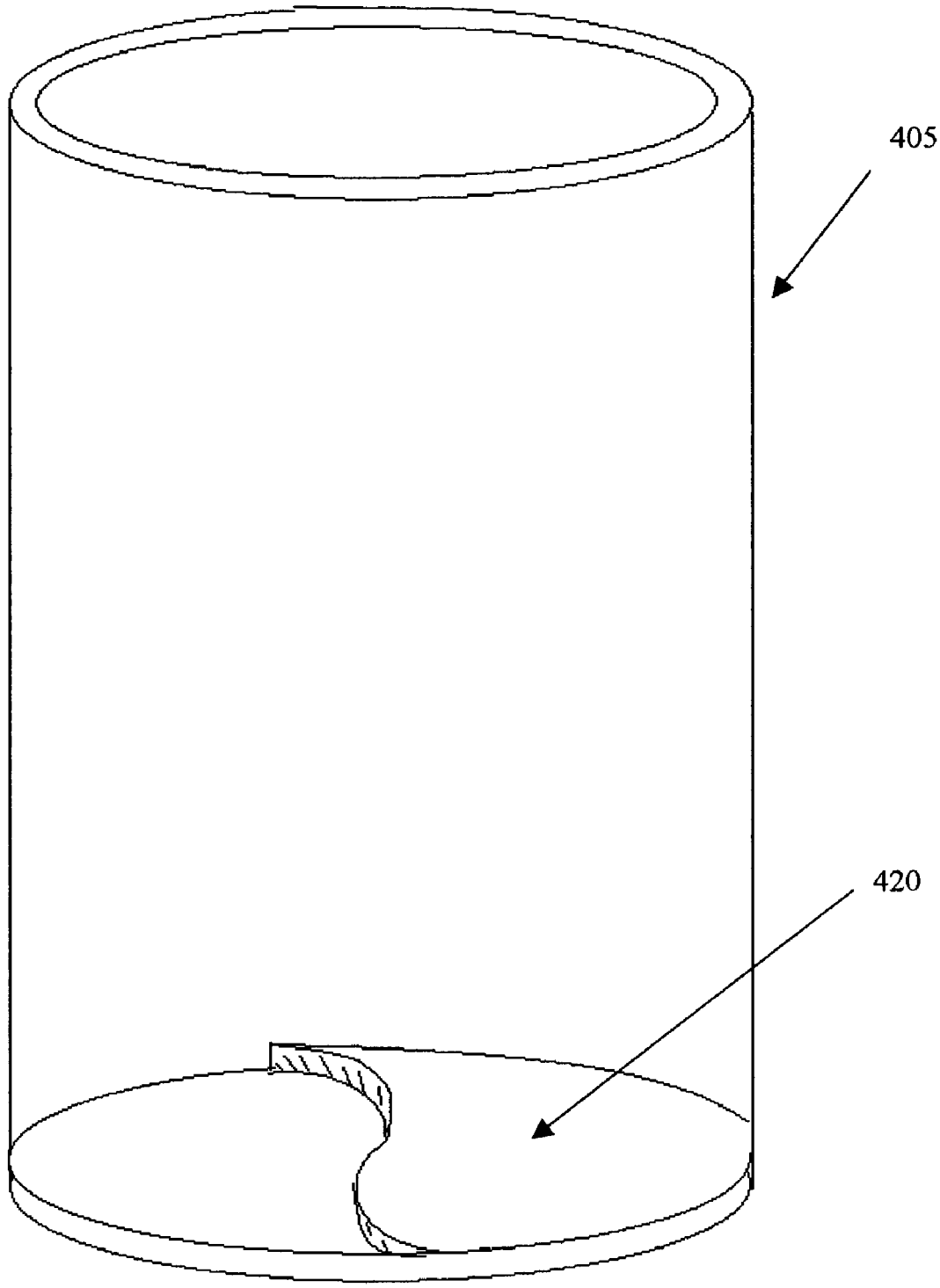
FIG. 4 shows a second embodiment of the device which includes a locking mechanism comprising cooperating elements formed on the external bottom of the bottle and the interior bottom of the housing.
Figure 5:
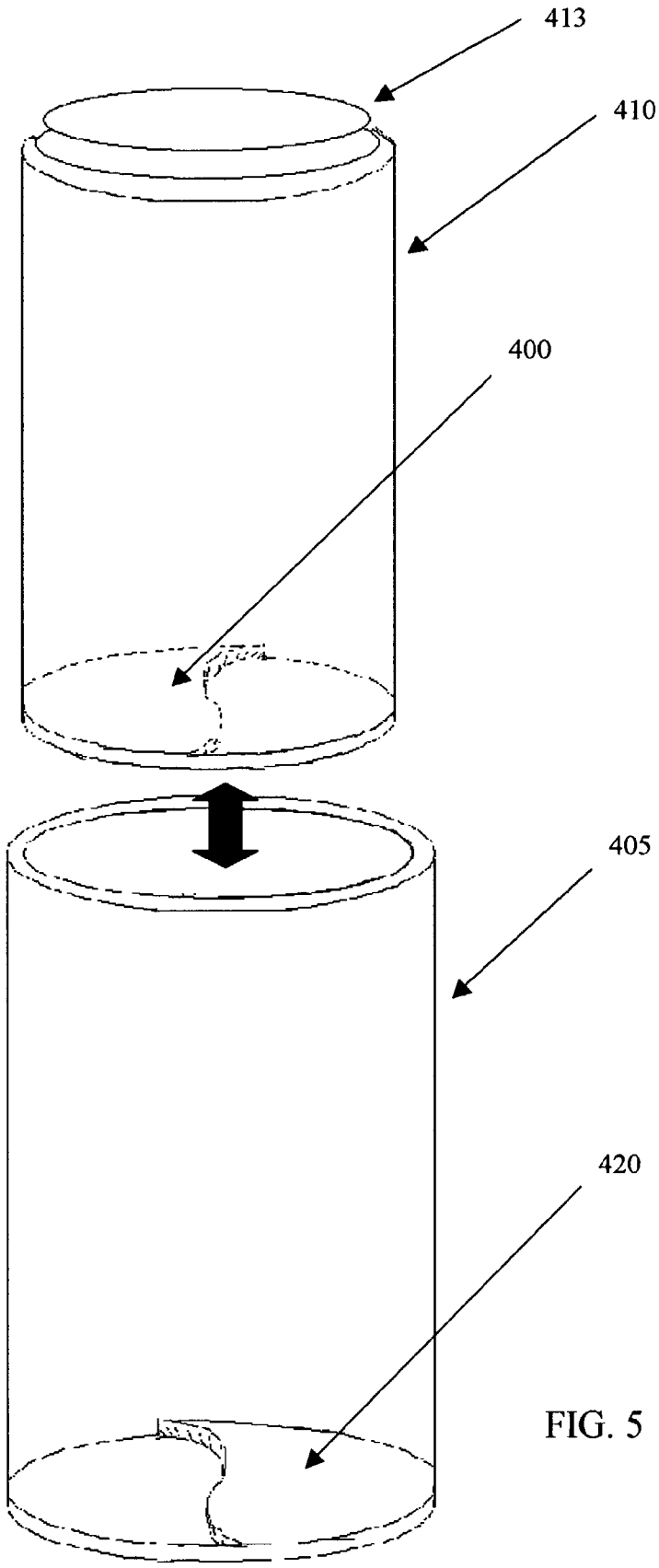
FIG. 5 shows the second embodiment with a container being placed into the housing.
Figure 6A:
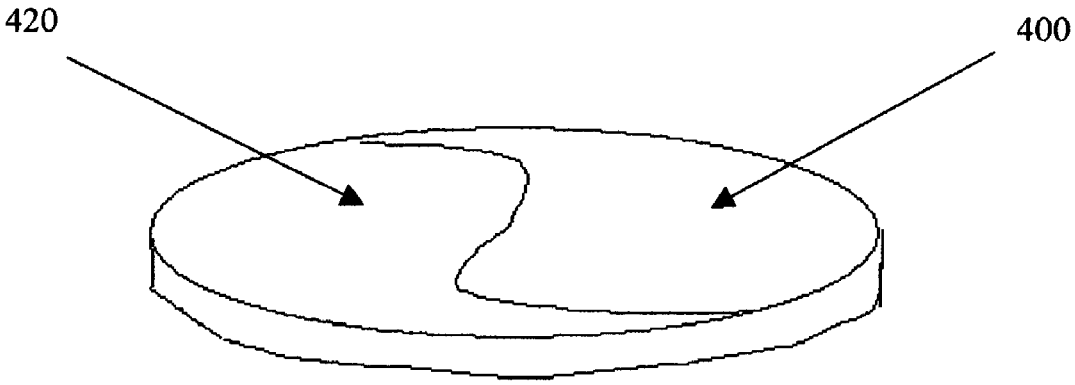
FIG. 6A–6C shows the detail of a locking mechanism.
Figure 6B:
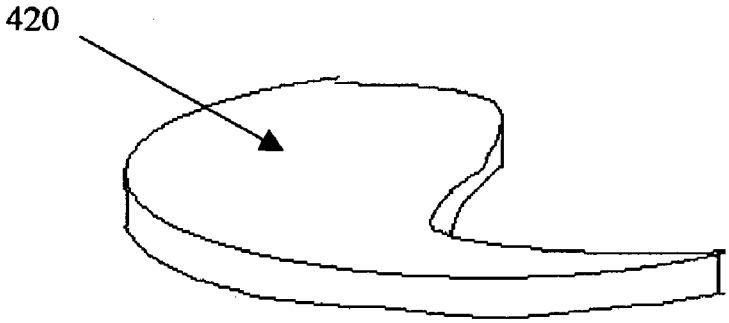
Figure 6C:
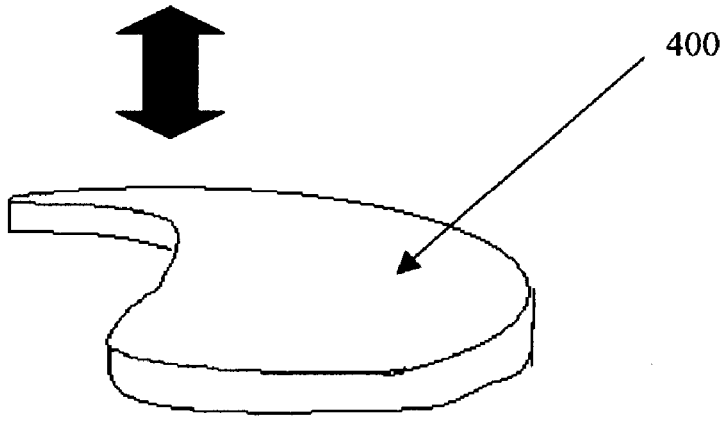
Figure 7:
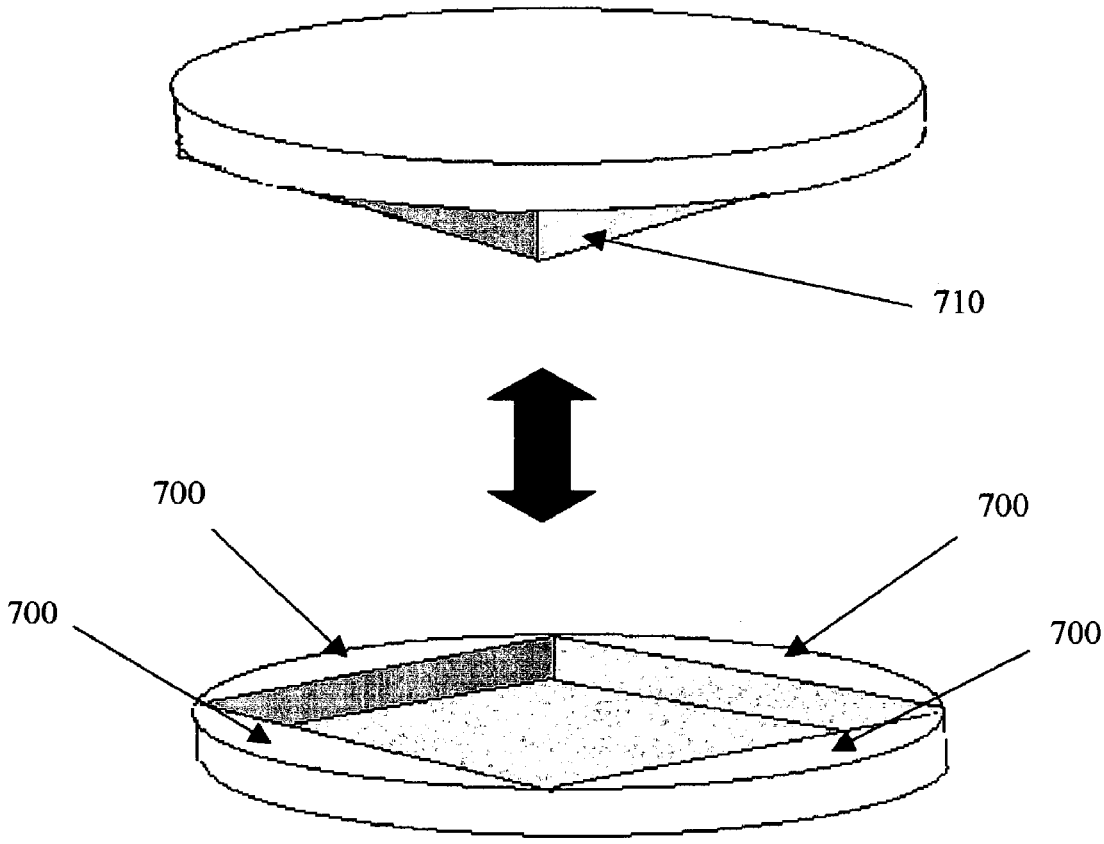
FIG. 7 shows an alternative shape for the locking mechanism.

FIGS. 4–6 show an alternative embodiment of the invention which includes an alternative means for preventing the bottle 410 from turning when the cap 413 is turned. This embodiment comprises a locking mechanism wherein a raised element 400 is molded into or is fixedly attached to the bottom of the bottle 410 and a cooperating raised element 420 is fixedly attached to the interior bottom of the housing 405 such that when the bottle 410 is placed into the housing 420 the raised elements cooperate to prevent the bottle from turning. In the embodiment shown, each of the raised elements 410, 420 is the mirror image of the other and together form a "yin-yang" shape. However, other cooperating raised elements are possible: for example, as shown in FIG. 7, raised chordular portions 700 of a circle formed on either the bottle or the housing can cooperate with a raised square or rectangle 710 formed on the counterpart. While pegs and indentations could be employed with similar effect, there are disadvantages associated with their use, as pegs formed on the bottom of the bottle would likely make the bottle unsteady, and indentations formed on either the bottle or the housing would require a base thicker than the length of the pegs and indentations, complicating manufacture.

Figure 8:
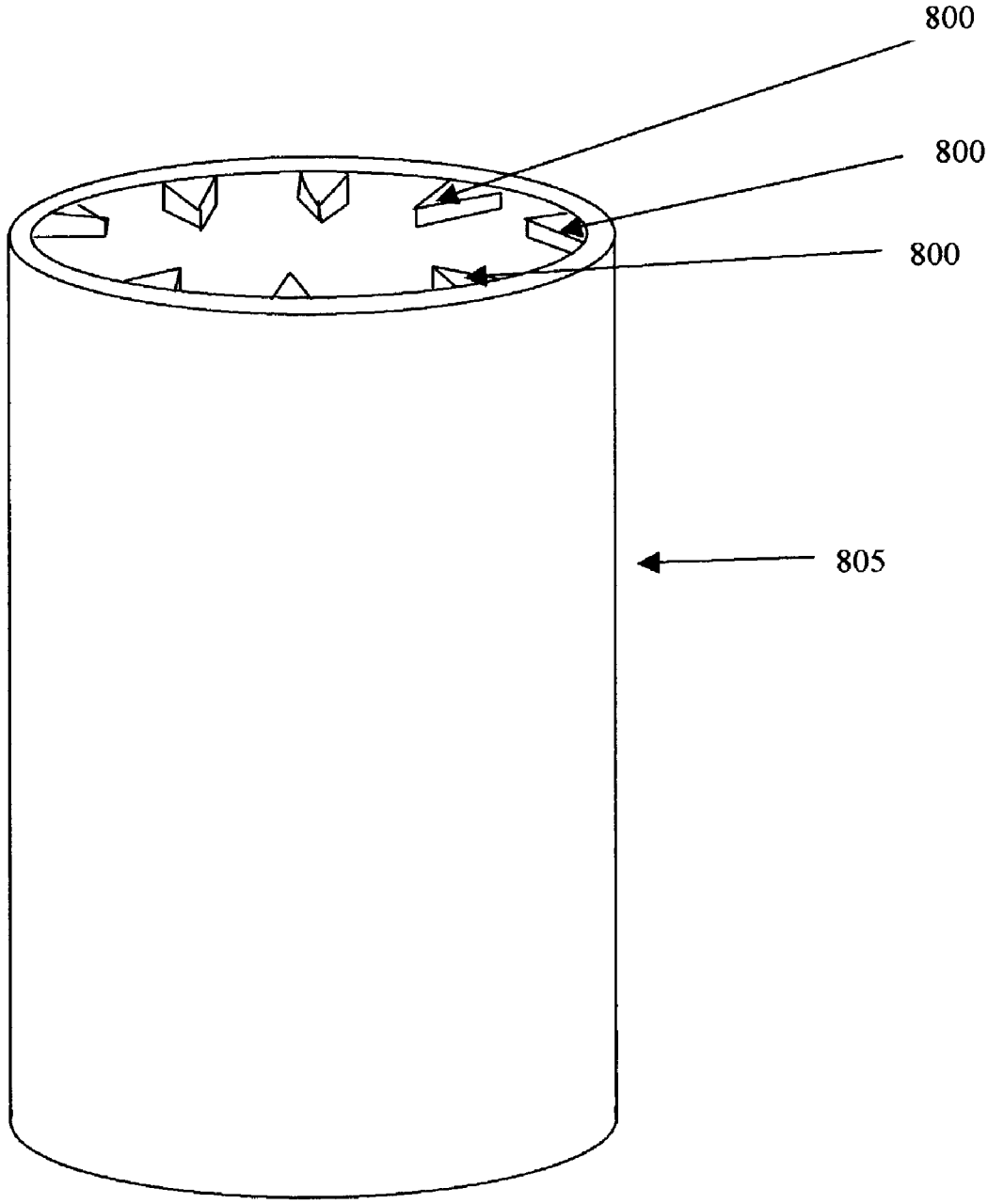
FIG. 8 shows a third embodiment of the device which includes a locking mechanism of cooperating ridges on the interior of the housing and the exterior of the bottle.
Figure 9:
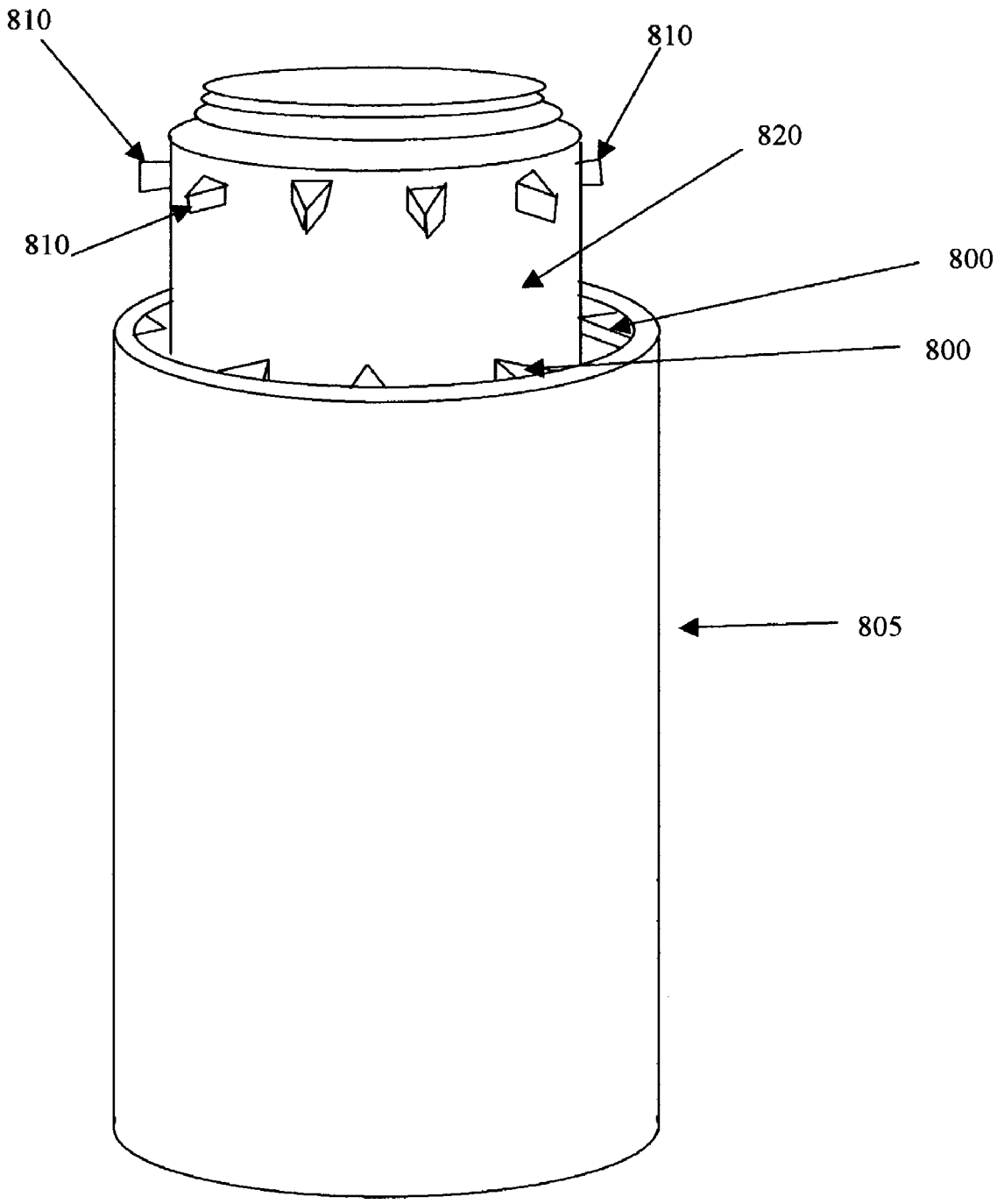
FIG. 9 shows a bottle with cooperating ridges being placed into the housing of the third embodiment.
Figure 10:
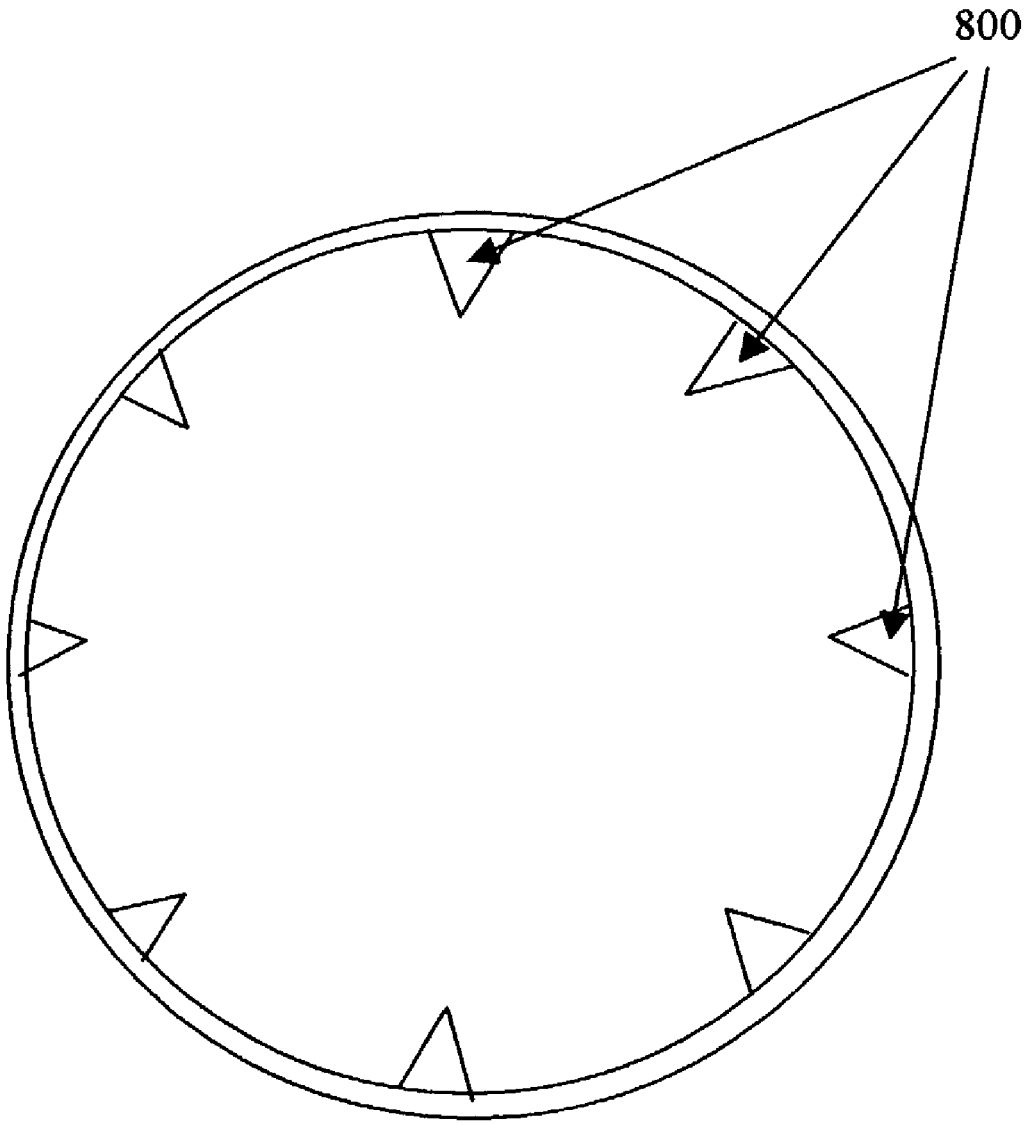
FIG. 10 shows a top view of the housing in the third embodiment.

Another possible locking mechanism is shown in FIGS. 8–10. In this embodiment, locking "ridges" 800 are formed on the interior wall of the housing of the device 805, preferably near the top or bottom so to avoid interfering with the magnification function. The ridges 800 cooperate with similar ridges 810 formed or placed on the exterior of the bottle 820 so as to allow the ridges 800, 810 to cooperate in preventing the bottle 820 from turning.

Figure 11A:
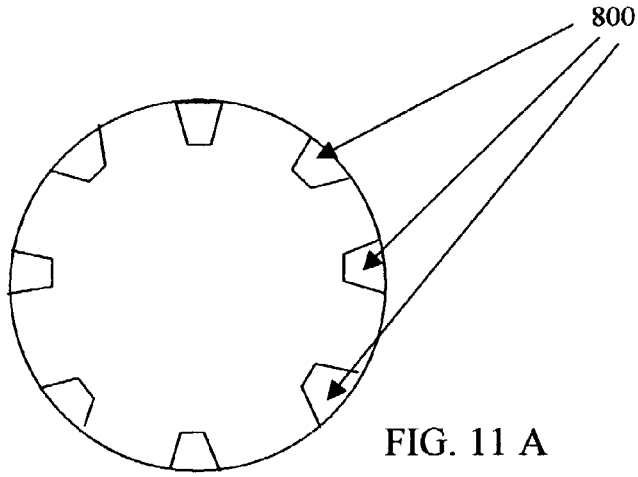
FIG. 11A–11B show alternative ridge shape designs.
Figure 11B:
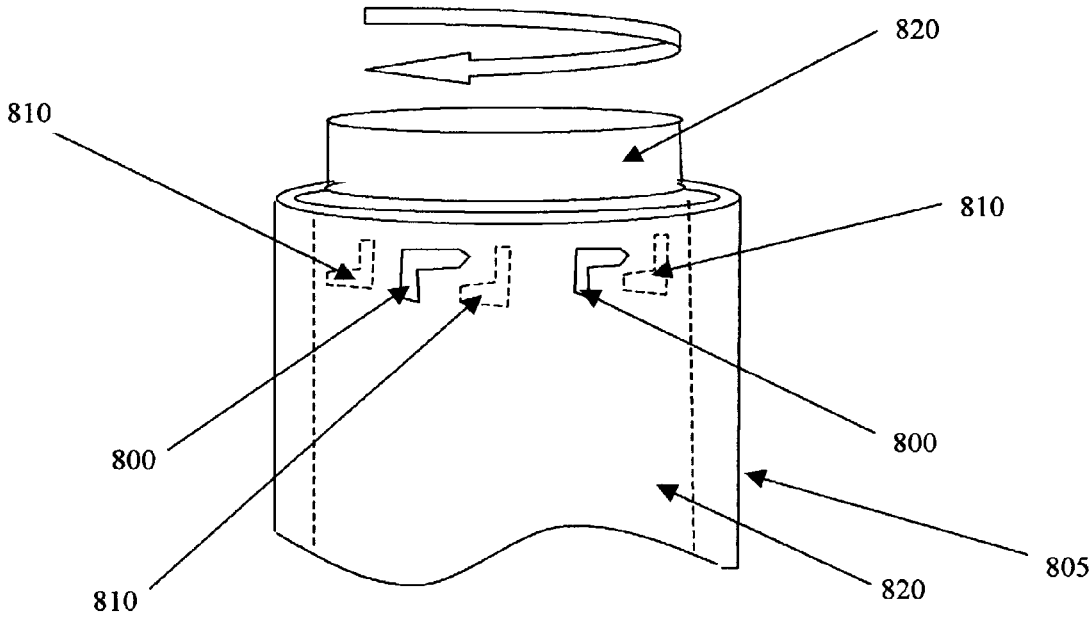

As shown in FIGS. 8–10, the ridges 800, 810 may be substantially triangular in profile ("tooth" shaped), or rectangular as shown in FIG. 11A, or alternatively, as shown in FIG. 11B, may form an interlocking design with portions of the ridges 800 on the housing 805 positioned and designed to fit over or under the cooperating ridges 810 on the bottle or other container 820, thus allowing the bottle 820 to be twisted slightly and locked into place both vertically and rotationally. An opposite twist, such as when closing the bottle, would return the bottle to the original position and allow the bottle 820 to be removed from the housing 805.

While the present invention has been shown and described with reference to the foregoing preferred embodiment, it will be apparent to those skilled in the art that other changes in form, connection, and detail may be made therein without departing from the spirit and scope of the invention as defined in the appended claims. For example, the housing could be substantially square or rectangular when viewed from the top to accommodate similarly shaped containers. With such a design, the shape of the housing and the container would in themselves act to prevent the rotation of the container relative to the housing when the container was inside the housing.

What is claimed is:

1. A magnifying device adapted for use with containers comprising:

a housing defining an interior comprising:

at least one wall comprising a magnifying material;

a bottom portion attached to the wall;

wherein the interior of the housing is adapted to receive removably a container having a label, such that a portion of the label is adjacent to the magnifying material when the container is within the interior of the housing; and a means for inhibiting rotational movement of the container relative to the housing when the container is within the interior of the housing, wherein the means for inhibiting rotational movement comprises a first raised portion in the interior of the housing attached to the bottom portion adapted for cooperation with a corresponding second raised portion attached to the container, and wherein the first raised portion and the second raised portion form a yin-yang shape.

2. A magnifying device adapted for use with containers comprising:

a substantially cylindrical housing defining an interior comprising:

at least one wail comprising a magnifying material;

a bottom portion attached to the wall;

wherein the interior of the housing is adapted to removably receive a container having a label, such that a portion of the label is adjacent to the magnifying material when the container is within the interior of the housing; and a means for inhibiting rotational movement of the container relative to the housing when the container is within the interior of the housing, wherein the means for inhibiting rotational movement of the container comprises a first raised portion in the interior of the housing attached to the bottom portion adapted for cooperation with a corresponding second raised portion attached to the container, and the first and second raised portions from a yin-yang shape.

* * * * *